US010594060B2

(12) United States Patent
Miyamura et al.

(10) Patent No.: US 10,594,060 B2
(45) Date of Patent: Mar. 17, 2020

(54) BOARD CONNECTOR

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Tetsuya Miyamura, Mie (JP); Masaaki Tabata, Mie (JP); Yasuo Omori, Mie (JP); Hajime Matsui, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 16/306,597

(22) PCT Filed: May 25, 2017

(86) PCT No.: PCT/JP2017/019512
§ 371 (c)(1),
(2) Date: Dec. 3, 2018

(87) PCT Pub. No.: WO2017/217207
PCT Pub. Date: Dec. 21, 2017

(65) Prior Publication Data

US 2019/0229448 A1 Jul. 25, 2019

(30) Foreign Application Priority Data

Jun. 15, 2016 (JP) ..... 2016-118634

(51) Int. Cl.
*H01R 12/57* (2011.01)
*H01R 12/51* (2011.01)
(Continued)

(52) U.S. Cl.
CPC ..... *H01R 12/57* (2013.01); *H01R 12/51* (2013.01); *H01R 12/712* (2013.01); *H01R 13/42* (2013.01); *H01R 13/502* (2013.01)

(58) Field of Classification Search
CPC ..... H01R 12/57; H01R 12/712; H01R 13/42; H01R 13/502
See application file for complete search history.

(56) References Cited

U.S. PATENT DOCUMENTS 5,186,633 A 2/1993 Mosser, III
6,036,506 A * 3/2000 Korsunsky ..... H01R 13/658 439/79
(Continued)

FOREIGN PATENT DOCUMENTS

JP 6-205831 8/1993
JP 8-222296 8/1996
(Continued)

OTHER PUBLICATIONS

International Search Report dated Aug. 22, 2017.

*Primary Examiner* — Xuong M Chung Trans
(74) *Attorney, Agent, or Firm* — Gerald E. Hespos; Michael J. Porco; Matthew T. Hespos

(57) ABSTRACT

A board connector includes a housing (10) mounted on a mounting surface (S) of a circuit board (P) and includes a terminal holding portion (11). Two types of long narrow terminal fittings (13, 20) are provided and each includes a board connecting portion (14, 21) extending in a front-rear direction and to be fixed to the mounting surface (S) behind the terminal holding portion (11). Each terminal connecting portion (15, 22) penetrates the terminal holding portion (11) in the front-rear direction. The terminal connecting portions (15, 22) have different heights from the mounting surface (S). The two types of terminal fittings (13, 20) include extra length links (16, 23) longer than heights of the terminal
(Continued)

connecting portions (15, 22) from the mounting surface (S) and linking front ends (14F, 21F) of the board connecting portions (14, 21) and rear ends (15R, 22R) of the terminal connecting portions (15, 22).

4 Claims, 6 Drawing Sheets

(51) Int. Cl.

| | |
|---|---|
| ***H01R 12/71*** | (2011.01) |
| ***H01R 13/42*** | (2006.01) |
| ***H01R 13/502*** | (2006.01) |

(56) References Cited

U.S. PATENT DOCUMENTS

| | | | | |
|---|---|---|---|---|
| 7,044,752 | B2 * | 5/2006 | Olson | H01R 13/41 439/79 |
| 7,645,146 | B2 * | 1/2010 | Lindkamp | H01R 12/721 439/79 |
| 8,070,529 | B2 * | 12/2011 | Xiong | H01R 12/725 439/676 |
| 8,979,594 | B2 * | 3/2015 | Tsai | H01R 13/6658 439/660 |
| 2013/0223039 | A1 | 8/2013 | Frank et al. | |

FOREIGN PATENT DOCUMENTS

| | | |
|---|---|---|
| JP | 2005-235498 | 9/2005 |
| JP | 2010-20984 | 1/2010 |
| JP | 2010-231961 | 10/2010 |
| JP | 2013-543241 | 11/2013 |

* cited by examiner

BOARD CONNECTOR

BACKGROUND

Field of the Invention

The invention relates to a board connector.

Related Art

Japanese Unexamined Patent Publication No. 2010-020984 discloses a board connector with a housing to be mounted on a circuit board and terminal fittings mounted in the housing. The housing is formed such that a receptacle projects forward from the outer periphery of a terminal holding portion. The terminal fitting includes a terminal connecting portion penetrating through the terminal holding portion in parallel to a mounting surface of the circuit board, a board connecting portion to be fixed to the mounting surface of the circuit board behind the terminal holding portion and a coupling linking the rear end of the terminal holding portion and the front end of the board connecting portion.

The above-described board connector requires two types of terminal fittings including the terminal connecting portions having different heights from the circuit board are prepared. The two types of terminal fittings including the terminal connecting portions having different heights also have different entire lengths. Thus, there is a problem of increasing manufacturing cost.

The invention was completed on the basis of the above situation and aims to reduce cost.

SUMMARY

The present invention is directed to a board connector with a housing formed such that a receptacle projects forward from an outer periphery of a terminal holding portion. The housing is mounted on a mounting surface of a circuit board. The connector a plurality of types of long and narrow terminal fittings. Each terminal fitting includes a board connecting portion and a terminal connecting portion. The board connecting portion extends in a front-rear direction and to be fixed to the mounting surface behind the terminal holding portion. The terminal connecting portion penetrates through the terminal holding portion in the front-rear direction. The terminal connecting portions of the plural types of terminal fittings have different heights from the mounting surface. At least one of the types of terminal fittings includes an extra length linking portion longer than the height of the terminal connecting portion from the mounting surface. The extra length linking portion links a front end of the board connecting portion and a rear end of the terminal connecting portion.

The height from the mounting surface of the terminal connecting portion of the terminal fitting including the extra length link can be set according to the shape of the extra length link. Accordingly, the types of terminal fittings including the terminal connecting portions having different heights can have a common entire length. Thus, cost can be reduced as compared to the case where plural types of terminal fittings having different entire lengths are prepared.

A rear end of the terminal connecting portion may be disposed behind a front end of the board connecting portion. Accordingly, the extra length linking portion can be sufficiently long.

DETAILED DESCRIPTION

First Embodiment

Figure 1:
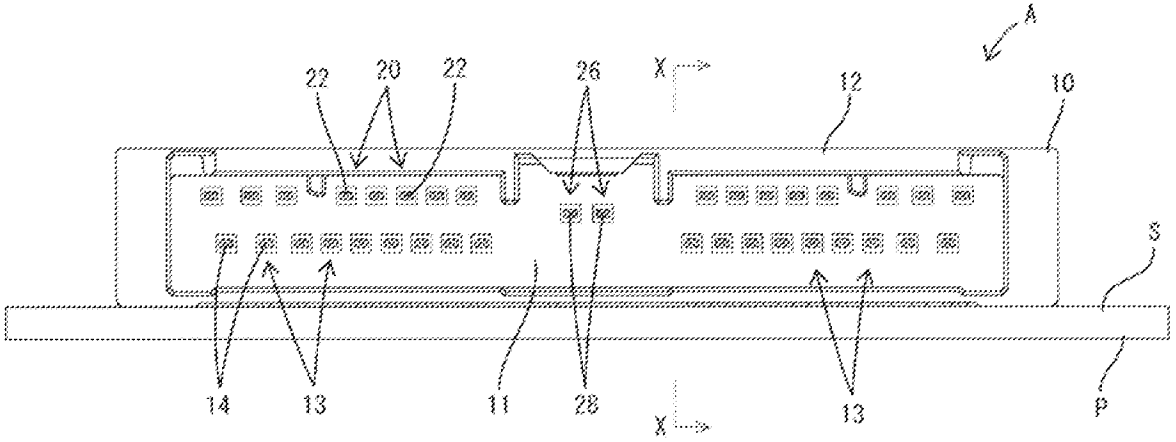
FIG. 1 is a front view of a board connector of a first embodiment 1.
Figure 2:
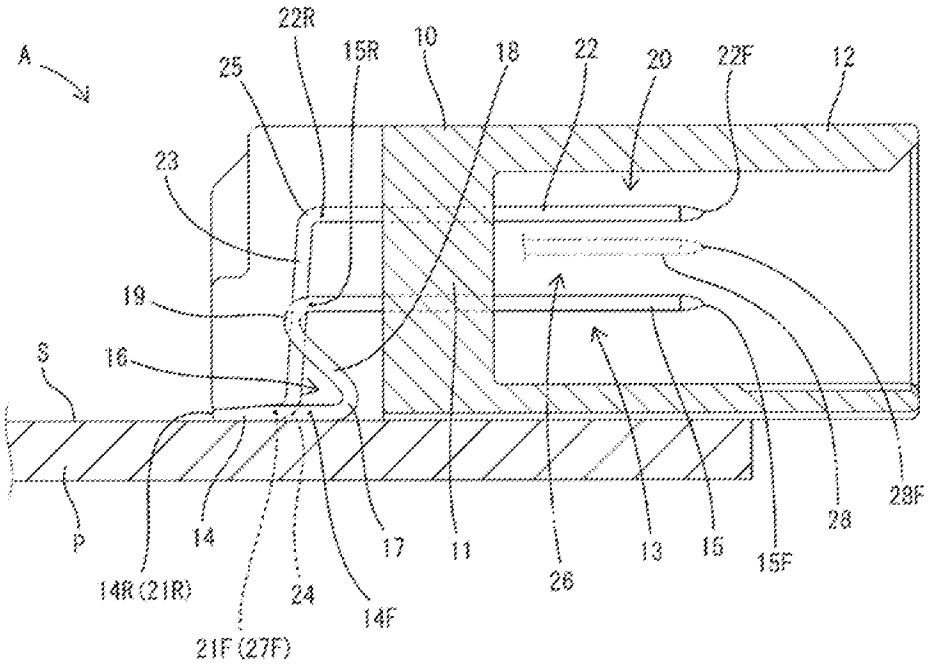
FIG. 2 is a section along X-X of FIG. 1.
Figure 3:
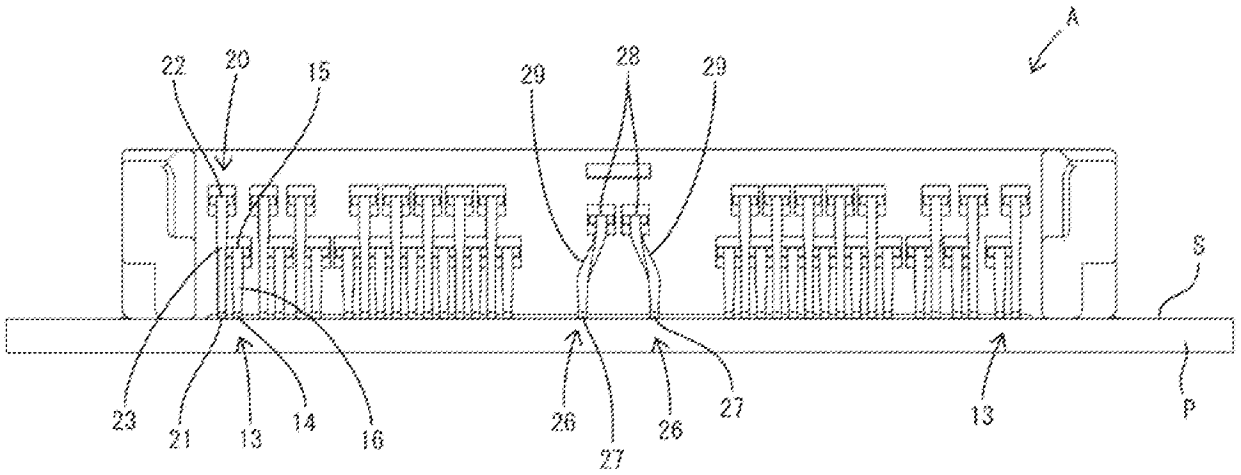
FIG. 3 is a back view of the board connector.

A first embodiment of the invention is described with reference to FIGS. 1 to 4. Note that, in the following description, a right side in FIG. 2 is defined as a front concerning a front-rear direction. Upper and lower sides shown in FIGS. 1 to 3 are defined as upper and lower sides concerning a vertical direction.

A board connector A of the first embodiment is to be mounted on a circuit board P having a horizontal mounting surface S (upper surface) formed with a printed circuit (not shown). The board connector A includes a housing 10 made of synthetic resin and to be mounted on the circuit board P by being placed on the mounting surface S. First, second and third terminal fittings 13, 20 and 26 (terminal fittings as claimed) are mounted in the housing 10.

The housing 10 includes a wall-like terminal holding portion 11 in the form of a wall aligned at substantially at a right angle to the mounting surface S and a receptacle 12 in the form of a rectangular tube projecting forward from the outer peripheral edge of the terminal holding portion 11. The housing 10 has a wide flat shape with a lateral dimension larger than a vertical dimension.

<First Terminal Fittings 13>

The first terminal fitting 13 is formed into a predetermined shape by bending one long and narrow metal wire material. The first terminal fitting 13 is a single component including a first board connecting portion 14 that is long and narrow in the front-rear direction, a first terminal connecting portion 15 that is long and narrow in the front-rear direction and a long and narrow first extra length link 16 having a bent shape in a side view.

All of the first terminal fittings 13 are disposed in an area of the housing 10 except a central part in a width direction (lateral direction). All of the first board connecting portions 14 are fixed to the mounting surface S at predetermined intervals in the width direction. Front ends 14F of all the first board connecting portions 14 are aligned at the same position in the front-rear direction, and rear ends 14R of all the first board connecting portions 14 are aligned at the same position in the front-rear direction. All of the first terminal connecting portions 15 are aligned at the same height position higher than the mounting surface S. Front ends 15F of all of the first terminal connecting portions 15 are aligned at the same position in the front-rear direction, and rear ends 15R of all of the first terminal connecting portions 15 are aligned at the same position in the front-rear direction.

In each first terminal fitting 13, the first board connecting portion 14 and the first terminal connecting portion 15 are aligned at the same position in the width direction. Likewise, in each first terminal fitting 13, the front end 14F of the first board connecting portion 14 is slightly in front of the rear end 15R of the first terminal connecting portion 15. The front end 14F of the first board connecting portion 14 and the rear end 15R of the first terminal connecting portion 15 are linked via the first extra length link 16.

As shown in FIG. 2, the entire length of the first extra length link 16 is longer than a height of the first terminal connecting portion 15 from the mounting surface S and is substantially S-shaped in a side view. Specifically, the first extra length link 16 is composed of a lower curved portion 17 rising while being folded to an upper-rear side from the front end 14F of the first board connecting portion 14, a straight portion 18 extending oblique to the upper-rear side from the upper end (rear end) of the lower curved portion 17 and an upper curved portion 19 rising while being folded to an upper-front side from the upper end (rear end) of the straight portion 18. The lower end (rear end) of the lower curved portion 17 and the front end 14F of the first board connecting portion 14 are connected smoothly. The upper end (front end) of the upper curved portion 19 and the rear end 15R of the first terminal connecting portion 15 are connected smoothly.

<Second Terminal Fittings 20>

The second terminal fitting 20 is formed into a predetermined shape by bending one long and narrow metal wire material. The entire length of the second terminal fitting 20 is equal to that of the first terminal fitting 13. The second terminal fitting 20 is a single component including a second board connecting portion 21 long and narrow in the front-rear direction, a second terminal connecting portion 22 long and narrow in the front-rear direction and a second extra length link 23 having a substantially straight shape in side and back views.

All of the second terminal fittings 20 are disposed in the area of the housing 10 except the central part in the width direction (lateral direction). All of the second board connecting portions 21 are fixed to the mounting surface S at predetermined intervals in the width direction. The first board connecting portions 14 and the second board connecting portions 21 are alternately disposed in the width direction. Rear ends 21R of all the second board connecting portions 21 are aligned at the same position in the front-rear direction and are aligned with the rear ends 14R of the first board connecting portions 14 at the same position in the front-rear direction. Front ends 21F of all of the second board connecting portions 21 are aligned at the same position in the front-rear direction and are disposed behind the front ends 14F of the first board connecting portions 14 in the front-rear direction.

Figure 4:
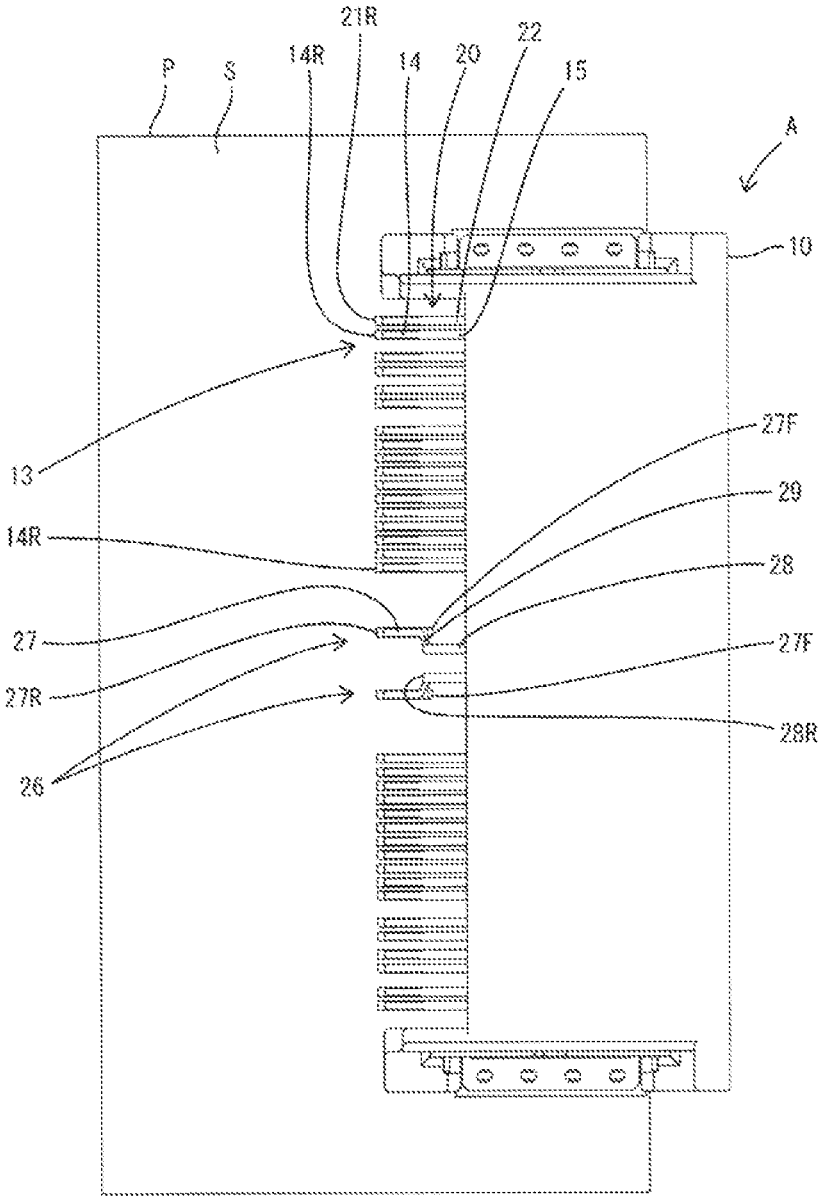
FIG. 4 is a plan view of the board connector.

As shown in FIGS. 1 and 3, all of the second terminal connecting portions 22 are aligned at the same height positions higher than the first terminal connecting portions 15 (higher than the mounting surface S). Front ends 22F of all of the second terminal connecting portions 22 are aligned at the same position in the front-rear direction and are aligned with the front ends 15F of the first terminal connecting portions 15 at the same position in the front-rear direction (see FIG. 2). As shown in FIG. 4, rear ends 22R of all the second terminal connecting portions 22 are aligned at the same position in the front-rear direction and disposed slightly in front of the rear ends 15R of the first terminal connecting portions 15 in the front-rear direction.

As shown in FIG. 3, in each second terminal fitting 20, the second board connecting portion 21 and the second terminal connecting portion 22 are aligned at the same position in the width direction. Likewise, in each second terminal fitting 20, the front end 21F of the second board connecting portion 21 is disposed slightly behind the rear end 22R of the second terminal connecting portion 22. The front end 21F of the second board connecting portion 21 and the rear end 22R of the second terminal connecting portion 22 are linked via the second extra length link 23.

As shown in FIG. 2, the second extra length link 23 has a substantially straight shape in a side view, and the entire length thereof is longer than a height of the second terminal connecting portion 22 from the second board connecting portion 21 (mounting surface S). Specifically, the second extra length link 23 is inclined slightly forward with respect to the second terminal connecting portion 22 and a direction perpendicular to the second terminal connecting portion 22 in a side view. Further, a lower end part of the second extra length linking portion 23 is connected smoothly to the front end 21F of the second board connecting portion 21 via a lower curved portion 24 having a small radius of curvature. An upper end part of the second extra length linking portion 23 is connected smoothly to the rear end 22R of the second terminal connecting portion 22 via an upper curved portion 25 having a small radius of curvature.

<Third Terminal Fitting 26>

The third terminal fitting 26 is formed into a predetermined shape by bending one long and narrow metal wire material. The entire length of the third terminal fitting 26 is shorter than those of the first and second terminal fittings 13, 20. The third terminal fitting 26 is a single component including a third board connecting portion 27 long and narrow in the front-rear direction, a third terminal connecting portion 22 long and narrow in the front-rear direction and a third extra length link 29 having a straight shape in side and back views.

As shown in FIGS. 1 and 3, the two third terminal fittings 26 are disposed in the central part of the housing 10 in the width direction (lateral direction). The two third board connecting portions 27 are fixed to the mounting surface S at a predetermined interval in the width direction. Front ends 27F of the two third board connecting portions 27 are aligned at the same position in the front-rear direction and are aligned with the front ends 21F of the second board connecting portions 21 at the same position in the front-rear direction. Rear ends 27R of the two third board connecting portions 27 are aligned at the same position in the front-rear direction and aligned with the rear ends 14R of the first board connecting portions 14 and the rear ends 21R of the second board connecting portions 21 at the same position in the front-rear direction.

Front ends 28F of the third terminal connecting portions 28 are aligned at the same position in the front-rear direction and are aligned with the front ends 15F of the first terminal connecting portions 15 and the front ends 22F of the second terminal connecting portions 22 at the same position in the front-rear direction (see FIG. 2). Rear ends 28R of the two third terminal connecting portions 28 are aligned at the same position in the front-rear direction and are disposed slightly in front of the rear ends 15R of the first terminal connecting portions and slightly behind the rear ends 22R of the second terminal connecting portions 22 in the front-rear direction.

In each third terminal fitting 26, the third board connecting portion 27 and the third terminal connecting portion 28 are disposed at different positions in the width direction. The two third terminal fittings 26 are bilaterally symmetrical. Specifically, as shown in FIG. 3, an interval in the width direction between two of the third board connecting portions 27 is wider than that between two of the third terminal connecting portions 28. Further, in each third terminal fitting 26, the front end 27F of the third board connecting portion 27 is slightly behind the rear end 28R of the third terminal connecting portion 28. The front end 27F of the third board connecting portion 27 and the rear end 28R of the third terminal connecting portion 28 are linked via the third extra length link 29.

The third extra length link 29 has a substantially straight shape in a side view, and the entire length thereof is longer than a height of the third terminal connecting portion 28 from the mounting surface S. Specifically, the third extra length link 29 is inclined slightly forward with respect to the third terminal connecting portion 28 and a direction perpendicular to the third terminal connecting portion 28 in a side view. This forward inclination angle is the same as that of the second extra length link 23. Further, the extra length link 29 also is inclined laterally with respect to the third terminal connecting portion 28 and the direction perpendicular to the third terminal connecting portion 28 in the side view. A lower end part of the third extra length link 29 is connected smoothly to the front end 27F of the third board connecting portion 27 via a lower bend (not shown) having a small radius of curvature. An upper end part of the third extra length link 29 is connected smoothly to the rear end 28R of the third terminal connecting portion 28 via an upper bend (not shown) having a small radius of curvature.

Effects of Embodiment

The board connector A of the first embodiment includes the housing 10, the first terminal fittings 13, the second terminal fittings 20 and the third terminal fittings 26. The housing 10 is formed such that the receptacle 12 projects forward from the outer periphery of the terminal holding portion 11, and is mounted on the mounting surface S of the circuit board P.

The first terminal fitting 13 includes the first board connecting portion 14 extending in the front-rear direction and to be fixed to the mounting surface S behind the terminal holding portion 11 and the first terminal connecting portion 15 penetrating through the terminal holding portion 11 in the front-rear direction. The height of the first terminal connecting portion 15 from the mounting surface S is lower than the heights of the second terminal connecting portion 22 of the second terminal fitting 20 and the third terminal connecting portion 28 of the third terminal fitting 26. The second terminal fitting 20 includes the second board connecting portion 21 extending in the front-rear direction and to be fixed to the mounting surface S behind the terminal holding portion 11 and the second terminal connecting portion 22 penetrating through the terminal holding portion 11 in the front-rear direction. The height of the second terminal connecting portion 22 from the mounting surface S is higher than the heights of the first and third terminal connecting portions 15 and 28.

The third terminal fitting 26 includes the third board connecting portion 27 extending in the front-rear direction and to be fixed to the mounting surface S behind the terminal holding portion 11 and the third terminal connecting portion 28 penetrating through the terminal holding portion 11 in the front-rear direction. The height of the third terminal connecting portion 28 from the mounting surface S is higher than that of the first terminal connecting portion 15 and lower than the second terminal connecting portion 22. As just described, the heights of the first terminal connecting portion, the second terminal connecting portion 22 and the third terminal connecting portion 28 from the mounting surface S are different from each other in the first, second and third terminal fittings 13, 20 and 26.

The first terminal fitting 13 includes the first extra length link 16 longer than the height of the first terminal connecting portion 15 from the mounting surface S and linking the front end 14F of the first board connecting portion 14 and the rear end 15R of the first terminal connecting portion 15. The second terminal fitting 20 includes the second extra length link 16 longer than the height of the second terminal connecting portion 22 from the mounting surface S and linking the front end 21F of the second board connecting portion 21 and the rear end 22R of the second terminal connecting portion 22. The third terminal fitting 26 includes the third extra length link 29 longer than the height of the third terminal connecting portion 28 from the mounting surface S and linking the front end 27F of the third board connecting portion 27 and the rear end 28R of the third terminal connecting portion 28.

The first extra length link 16 of the first terminal fitting 13 is bent into a substantially S shape, and the height of the first terminal connecting portion 15 from the mounting surface S is set according to the shape of the first extra length link 16. Since the rear end 15R of the first terminal connecting portion 15 is disposed behind the front end 14F of the first board connecting portion 14, the length of the first extra length link 16 is ensured to be sufficiently long. Further, the second extra length link 23 of the second terminal fitting 20 is inclined with respect to the direction perpendicular to the mounting surface S and both upper and lower end parts of the second extra length link 23 are formed into the arcuate curved portions 24, 25. Thus, the height of the second terminal connecting portion 22 from the mounting surface S is set according to the shape of the second extra length link 23.

As just described, the first and second terminal fittings 13, 20 are provided respectively with the first and second extra length links 16, 23 so that the heights of the first and second terminal connecting portions 15, 22 from the mounting surface S are different from each other. Two types of terminal fittings (first and second terminal fittings 13, 20) including the first and second terminal connecting portions 15, 22 having different heights can have a common entire length. Thus, cost for the board connector A of the first embodiment can be reduced as compared to the case where a plurality of types of terminal fittings having different entire lengths are prepared.

Second Embodiment

Figure 5:
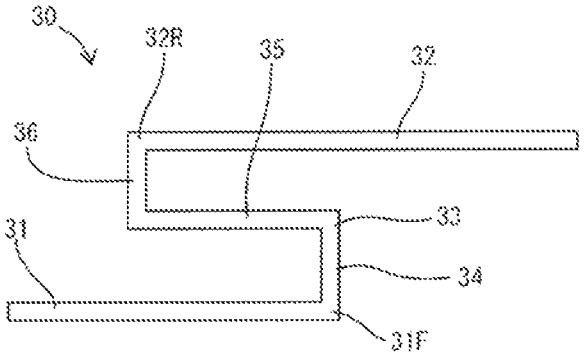
FIG. 5 is a side view of a terminal fitting of a second embodiment.

A second embodiment of the invention is described with reference to FIG. 5. In a terminal fitting 30 of the second embodiment, a rear end 32R of a terminal connecting portion 32 is located behind a front end 31F of a board connecting portion 31. The front end 31F of the board connecting portion 31 and the rear end 32R of the terminal connecting portion 32 are linked via an extra length link 33. The extra length link 33 has an entire length longer than a height of the terminal connecting portion 32 from the board connecting portion 31 (mounting surface S) and is substantially S-shaped in a side view. The extra length link 33 includes a first straight portion 34 extending up substantially at a right angle from the front end 31F of the board connecting portion 31, a second straight portion 35 extending rearward substantially at a right angle from the upper end of the first straight portion 34 and a third straight portion 36 extending up substantially at a right angle from the rear end of the second straight portion 35. The upper end of the third straight portion 36 is connected substantially at a right angle to the rear end 32R of the terminal connecting portion 32.

Third Embodiment

Figure 6:
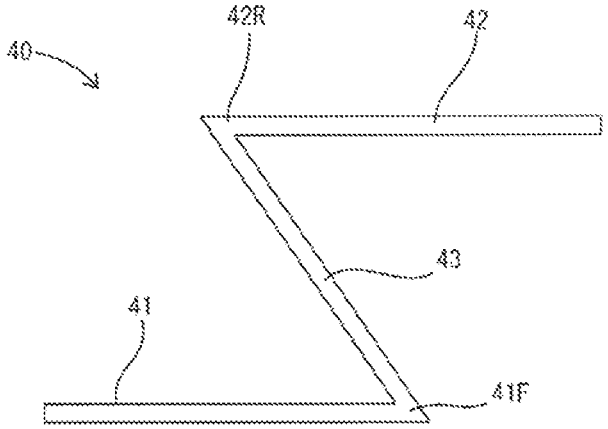
FIG. 6 is a side view of a terminal fitting of a third embodiment.

A third embodiment of the invention is described with reference to FIG. 6. In a terminal fitting 40 of the third embodiment, a rear end 42R of a terminal connecting portion 42 is located behind a front end 41F of a board connecting portion 41. The front end 41F of the board connecting portion 41 and the rear end 42R of the terminal connecting portion 42 are linked via an extra length link 43. The extra length link 43 has an entire length longer than a height of the terminal connecting portion 42 from the board connecting portion 41 (mounting surface S) and has a straight shape in a side view. Specifically, the extra length linking portion 43 is inclined rearward with respect to a vertical direction perpendicular to length directions of the board connecting portion 41 and the terminal connecting portion 42. The lower end of the extra length link 43 is connected at an acute angle to the front end 41F of the board connecting portion 41 and the upper end thereof is connected at an acute angle to the rear end 42R of the terminal connecting portion 42.

Fourth Embodiment

Figure 7:
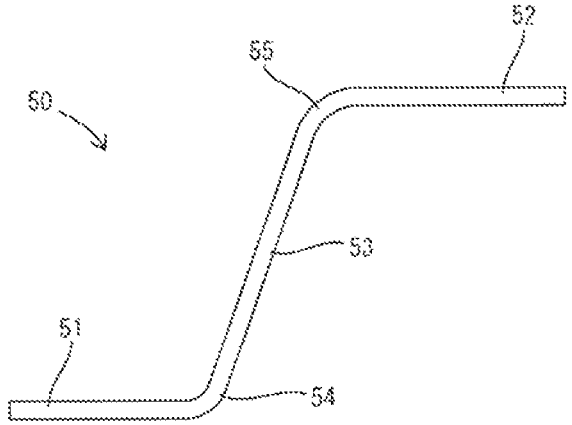
FIG. 7 is a side view of a terminal fitting of a fourth embodiment.

A fourth embodiment of the invention is described with reference to FIG. 7. In a terminal fitting 50 of the fourth embodiment, a rear end 52R of a terminal connecting portion 52 is located in front of a front end 51F of a board connecting portion 51. The front end 51F of the board connecting portion 51 and the rear end 52R of the terminal connecting portion 52 are linked via an extra length link 53. The extra length link 53 has an entire length longer than a height of the terminal connecting portion 52 from the board connecting portion 51 (mounting surface S) and has a straight shape in a side view. The extra length link 53 is inclined forward with respect to a vertical direction perpendicular to length directions of the board connecting portion 51 and the terminal connecting portion 52. A lower end part of the extra length link 53 is connected smoothly to the front end 41F of the board connecting portion 41 via a lower curved portion 54 and an upper end part thereof is smoothly connected to the rear end 52R of the terminal connecting portion 52 via an upper curved portion 55.

Fifth Embodiment

Figure 8:
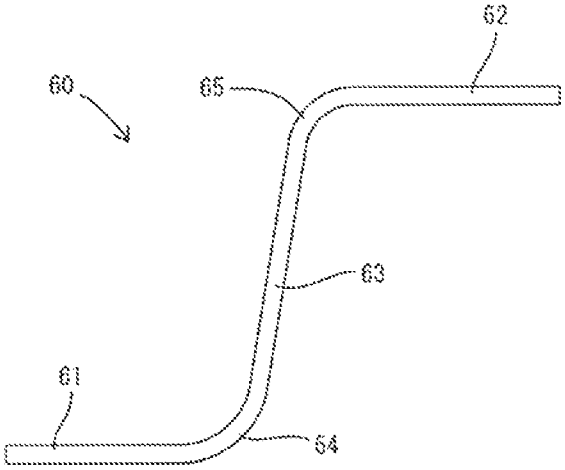
FIG. 8 is a side view of a terminal fitting of a fifth embodiment.

A fifth embodiment of the invention is described with reference to FIG. 8. In a terminal fitting 60 of the fifth embodiment, a rear end 62R of a terminal connecting portion 62 is located in front of a front end 61F of a board connecting portion 61. The front end 61F of the board connecting portion 61 and the rear end 62R of the terminal connecting portion 62 are linked via an extra length link 63. The extra length link 63 has an entire length longer than a height of the terminal connecting portion 62 from the board connecting portion 61 (mounting surface S) and has a straight shape as a whole in a side view. The extra length link 63 is inclined slightly forward with respect to a vertical direction perpendicular to length directions of the board connecting portion 61 and the terminal connecting portion 62.

A lower end part of the extra length link 63 is connected smoothly to the front end 61F of the board connecting portion 61 via a lower curved portion 64 and an upper end part thereof is smoothly connected to the rear end 62R of the terminal connecting portion 62 via an upper curved portion 65. The extra length link 63 of the fifth embodiment is inclined forward less than the extra length link 53 of the fourth embodiment, and at an angle close to a right angle. Radii of curvature of the lower and upper curved portions 64, 65 of the extra length link 63 of the fifth embodiment are larger than those of the lower and upper curved portions 54, 55 of the extra length link 53 of the fourth embodiment.

OTHER EMBODIMENTS

The invention is not limited to the above described and illustrated embodiments. For example, the following embodiments also are included in the scope of the invention.

Although all the first to third terminal fittings including the terminal connecting portions having different heights include the extra length links in the above first embodiment, only one or two types of terminal fittings, out of the first to third terminal fittings, may include the extra length links.

Although the rear ends of the board connecting portions are aligned at the fixed position in the front-rear direction among the terminal fittings with the terminal connecting portions having different heights in the first embodiment, the rear ends of board connecting portions may be different in the front-rear direction among terminal fittings with terminal connecting portions having different heights.

Although the front ends of the terminal connecting portions are aligned at the fixed position in the front-rear direction among the three types of terminal fittings including the terminal connecting portions having different heights in the first embodiment, the front ends of terminal connecting portions may be different in the front-rear direction among types of terminal fittings with the terminal connecting portions having different heights.

Although the first and second terminal fittings have the same entire length in the first embodiment, all three types of terminal fittings may have the same entire length.

Although the three types of terminal fittings including the terminal connecting portions having different heights are mounted in one housing in the first embodiment, only two types or four or more types of terminal fittings may be mounted in one housing.

LIST OF REFERENCE SIGNS

A . . . board connector
P . . . circuit board
S . . . mounting surface
10 . . . housing
11 . . . terminal holding portion
12 . . . receptacle
13 . . . first terminal fitting
14 . . . first board connecting portion
14F . . . front end of first board connecting portion
15 . . . first terminal connecting portion
15F . . . front end of first terminal connecting portion
15R . . . rear end of first terminal connecting portion
16 . . . first extra length link
20 . . . second terminal fitting
21 . . . second board connecting portion
21F . . . front end of second board connecting portion
21R . . . rear end of second board connecting portion
23 . . . second terminal connecting portion
22F . . . front end of second terminal connecting portion
22R . . . rear end of second terminal connecting portion
23 second extra length link

26 third terminal fitting
27 third board connecting portion
27F . . . front end of third board connecting portion
27R . . . rear end of third board connecting portion
28 third terminal connecting portion
28F . . . front end of third terminal connecting portion
28R . . . rear end of third terminal connecting portion
29 third extra length link
30, 40, 50, 60 terminal fitting
31, 41, 51, 61 board connecting portion
31F, 41F, 51F, 61F . . . front end of board connecting portion
32, 42, 52, 62 terminal connecting portion
32R, 42R, 52R, 62R rear end of terminal connecting portion
33, 43, 53, 63 extra length link

The invention claimed is:

1. A board connector, comprising:

a housing formed with a terminal holding portion, the housing being mounted on a mounting surface of a circuit board;

a plurality of first long and narrow terminal fittings each including a first board connecting portion extending in a front-rear direction and to be fixed to the mounting surface behind the terminal holding portion and a first terminal connecting portion penetrating through the terminal holding portion in the front-rear direction, the first terminal connecting portions being mounted in the terminal holding portions at first heights from the mounting surface; and a plurality of second long and narrow terminal fittings each including a second board connecting portion extending in a front-rear direction and to be fixed to the mounting surface behind the terminal holding portion and a second terminal connecting portion penetrating through the terminal holding portion in the front-rear direction, the second terminal connecting portions being mounted in the terminal holding portions at second heights from the mounting surface, the second heights being greater than the first heights;

wherein all of the terminal fittings have equal lengths, and wherein the first board connecting portion of each of the first terminal fittings includes an extra link with a length equal to a height difference between the first height and the second height, the extra length link linking a front end of the board connecting portion of the first terminal fittings and a rear end of the terminal connecting portion of the first terminal fittings.

2. The board connector of claim 1, wherein a rear end of the terminal connecting portion of each of the first terminal fittings is disposed behind a front end of the board connecting portion of each of the first terminal fittings.

3. The board connector of claim 1, further comprising a plurality of third long and narrow terminal fittings each including a third board connecting portion extending in a front-rear direction and to be fixed to the mounting surface behind the terminal holding portion and a third terminal connecting portion penetrating through the terminal holding portion in the front-rear direction, the third terminal connecting portions being mounted in the terminal holding portions at third heights from the mounting surface, the third heights being greater than the first heights and less than the second heights, wherein the third terminal fittings have lengths equal to the lengths of the first and second terminal fittings, and wherein the third board connecting portion of each of the third terminal fittings includes an extra link equal in length to a height difference between the third height and the second height.

4. The board connector of claim 1 wherein the first and second board connecting portions are fixed to the circuit board at positions that are aligned with one another.

* * * * *